US010428603B2

(12) United States Patent
Gylling

(10) Patent No.: US 10,428,603 B2
(45) Date of Patent: Oct. 1, 2019

(54) METHOD FOR PUTTING TOGETHER A DOWN-THE-HOLE DRILLING APPARATUS FOR PLASTIC PIPE DRILLING AND A DOWN-THE-HOLE DRILLING APPARATUS

(71) Applicant: Oy Atlas Copco Rotex AB, Tampere (FI)

(72) Inventor: Kai Gylling, Tampere (FI)

(73) Assignee: OY EPIROC DRILLING TOOLS AB, Tampere (FI)

( * ) Notice: Subject to any disclaimer, the term of this patent is extended or adjusted under 35 U.S.C. 154(b) by 181 days.

(21) Appl. No.: 15/320,987

(22) PCT Filed: Jun. 4, 2015

(86) PCT No.: PCT/FI2015/050386
§ 371 (c)(1),
(2) Date: Dec. 21, 2016

(87) PCT Pub. No.: WO2016/016509
PCT Pub. Date: Feb. 4, 2016

(65) Prior Publication Data

US 2017/0198535 A1 Jul. 13, 2017

(30) Foreign Application Priority Data

Jul. 28, 2014 (FI) ..... 20145695

(51) Int. Cl.
*E21B 19/18* (2006.01)
*E21B 17/04* (2006.01)
(Continued)

(52) U.S. Cl.
CPC ..... *E21B 19/18* (2013.01); *E21B 7/20* (2013.01); *E21B 10/26* (2013.01); *E21B 17/04* (2013.01); *E21B 17/042* (2013.01)

(58) Field of Classification Search
CPC ..... E21B 19/18
See application file for complete search history.

(56) References Cited

U.S. PATENT DOCUMENTS 5,796,045 A * 8/1998 Lancien ..... B29C 57/02 156/86
5,813,484 A 9/1998 Ekstrom
2003/0067166 A1* 4/2003 Sivley, IV ..... E21B 17/042 285/333

FOREIGN PATENT DOCUMENTS

EP 0062378 * 3/1982
WO WO 2013/076360 * 5/2013
WO WO-2013/076360 A1 5/2013

OTHER PUBLICATIONS

International Search Report and Written Opinion of the International Searching Authority dated Oct. 22, 2015 in corresponding International Application No. PCT/FI2015/050386.

* cited by examiner

*Primary Examiner* — D. Andrews
(74) *Attorney, Agent, or Firm* — Venable LLP; Jeffri A. Kaminski

(57) ABSTRACT

A method for putting together a down-the-hole drilling apparatus for plastic pipe drilling. The down-the-hole drilling apparatus has a drilling device for carrying out drilling by using a drilling unit with a plastic pipe, which drilling unit includes in its drilling head a drilling arrangement. The plastic pipe is arranged to be pulled into the hole to be drilled by a power influence directed thereto from the drilling unit, being coupled with the second drilling means in a manner transmitting power at least in the longitudinal direction of the drilling device. The drilling unit and the plastic pipe are coupled by a skirt part that exists at an opposite end of the drilling arrangement, with respect to the drilling surface of (Continued)

the drilling unit, which skirt part has an internal protrusion assembly in radial direction.

11 Claims, 4 Drawing Sheets

(51) Int. Cl.

| | |
|---|---|
| ***E21B 7/20*** | (2006.01) |
| ***E21B 10/26*** | (2006.01) |
| ***E21B 17/042*** | (2006.01) |

METHOD FOR PUTTING TOGETHER A DOWN-THE-HOLE DRILLING APPARATUS FOR PLASTIC PIPE DRILLING AND A DOWN-THE-HOLE DRILLING APPARATUS

The invention relates to a method for putting together a down-the-hole drilling apparatus for plastic pipe drilling and a down-the-hole drilling apparatus according to the preambles of the independent claims.

Away to carry out down-the-hole drilling in ordinary metal pipe drilling in a deviant manner from traditional asymmetric wing drilling technique is known e.g. from Finnish Patent No. 95618. A drilling head in a drilling unit of the drilling apparatus presented in this patent, existing inside a plastic pipe or in other words a so called earth pipe or casing pipe, is formed of a first frame part and an annular second frame part, the drilling surfaces of which being provided with drilling organs, such as drill bits or like, of the first and second drilling means or in other words of a center drill or a pilot and a reaming drill or a reamer. In this solution the first frame part comprising the first drilling means, is being released from the second frame part comprising the reamer, in order to pull the same alone off from a drilled hole after the drilling situation.

In the solution in question, the second organs of the flushing means for removal of drilling waste being generated are arranged to lead drilling waste by means of an assembly, which locks the said drilling means together for a drilling situation unrotatively in respect with each other and in both directions longitudinally, which is in other words carried out as an advantageous embodiment by loosening grooves of a bayonet coupling, being placed longitudinally on a side surface of the first frame part.

Figure 1:
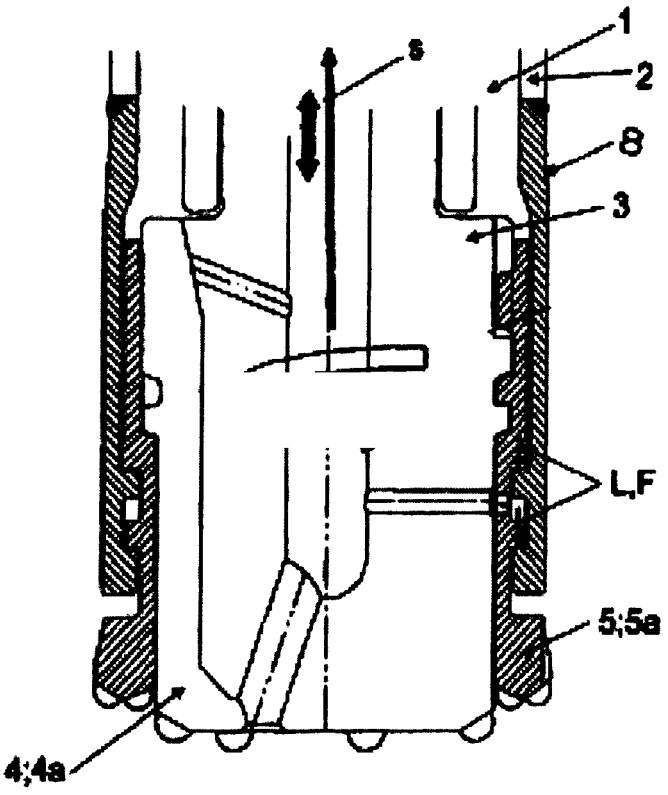
FIG 1. Prior art

In connection with a drilling device of the type described above, typically a casing shoe is being used at the end of the plastic pipe, by means of which the plastic pipe is pulled into the hole to be drilled by a power influence (F) that is directed to the casing shoe either from the pilot or the reamer. In FIG. 1 presenting prior art is shown as an example a construction in which the casing part is being pulled into the hole to be drilled by a power influence (F) transmitted through the casing shoe by means of joint organs (L) between the same and the reamer i.e. two pulling shoulder assemblies in the longitudinal direction one after the other in the parts in question.

Putting together a drilling head according to FIG. 1 takes place typically so that an essentially elongated, in a manner of speaking sleeve-like, casing shoe is being cut during amounting phase in a machine shop longitudinally at one point and spread open, whereafter it is being pressed together over the reamer. After this, it is being welded by its cutting point back to form once again as a uniform ring. The most remarkable disadvantage of this kind of a structure, being welded together, is the weak point due to the welding seam in the casing shoe, which gets very easily broken under difficult circumstances. A further disadvantage of this solution are thus those "extra" working phases related thereto, because the casing shoe must first of all be cut longitudinally, pressed onto the reamer and finally once again welded together.

Furthermore e.g. from patent EP 1144797 it is known to exploit a so called shrinking method in forming of the joint organs between a casing shoe and a rotationally symmetrical drill, in which case the casing shoe is being pressed radially in a way that a locking projection therein gets coupled with a corresponding locking recess in the drill.

Furthermore particularly applications for use of so called plastic pipe drilling typically e.g. well drilling or e.g. forepoling come into question. An advantage of use of a plastic pipe in drilling is first of all the fact that plastic pipes are very light compared to steel pipes, thanks to which they also have more profitable transport costs and they are easier to handle at a construction site. Furthermore a plastic pipe is significantly cheaper than a corresponding steel pipe. A plastic pipe does not rust for that matter and when being mounted into the ground, it does not break the bits of crushers or drills, when the soil is later on being e.g. worked or drilled. Furthermore in caves or quarries, metal may not blend with broken rocks, which is why use of plastic pipes in drilling has a very remarkable meaning in that context as well.

Today significant problems are, however, related to plastic pipe drilling, which is why it is not possible to exploit the same to the extent that there is a need for or that there are possibilities in practice. This is among other things due to the fact that the present arrangements require first of all use of a steel pipe in the beginning of drilling, whereby it is only after that possible to start using in the drilling a plastic pipe to be coupled with the steel pipe e.g. by a screw joint and after that further plastic pipes to be coupled with each other one after the other. On the other hand, solutions are being used, which are based on a screw joint coupling between a plastic pipe with a readymade threading and a casing shoe.

The former solution of the ones explained above is not satisfactory first of all due to the fact that there is still a need for use of a steel pipe in the starting phase, whereby it is possible to exploit plastic pipes with preworked threadings only after the starting phase. On the other hand, use of plastic pipes with readymade threadings has, however, found out to be also very difficult in practice, because a threaded part of a plastic pipe being coupled with a casing shoe made of steel easily gets cut due to differences in shapes of mutual threadings in the parts in question. The problems related to the use of preworked threadings in plastic pipes are mostly due to the differences of steel and plastic e.g. because of strength and thermal expansion characteristics thereof and the like reasons.

There have been efforts for further development of joint arrangements in plastic pipes with readymade threadings e.g. by using first of all a coupling part coupled with the plastic pipe with a screw joint and on the other hand a very long coupling stem in the casing shoe with necessary elasticity means, such as dampening O-rings, despite of which a joint between a casing shoe and a plastic pipe to be carried out with reasonable costs has not been managed to reliably accomplish so far.

All the types of arrangements described above require unnecessarily massive arrangements in carrying out a joint between the casing shoe and the plastic pipe, which is why they increase the manufacturing costs disproportionately and make use of the solutions in question significantly more difficult in practical installation work.

Particularly for the part of a drilling apparatus comprising a rotationally symmetrical pilot and a reamer, there has been found a further need for development of its construction particularly with a view plastic pipe drilling due to the problems related to use of a traditional casing shoe, because the type of solutions described above for the mutual coupling of a drilling unit and a plastic pipe have been found unsatisfactory.

It is an aim of the method for putting together a down-the-hole drilling apparatus for plastic pipe drilling and the down-the-hole drilling apparatus according to the present invention to achieve a decisive improvement particularly for the putting together of the type of down-the-hole drilling apparatus described above and for the down-the-hole drilling apparatus and thus to raise essentially the level of prior art. In order to carry out this aim, the method and the down-the-hole drilling apparatus according to the invention are mainly characterized by what has been presented in the characterizing parts of the independent claims related thereto.

As the most important advantages of the method and the down-the-hole drilling apparatus according to the invention may be mentioned simplicity of constructions and operating principles enabled by the same first of all thanks to the fact that the functionality of the rotationally symmetrical drilling apparatus, being found profitable in practice as such, can be further improved, because thanks to the invention it is possible to make more efficient particularly the mounting phases related to the putting together of a drilling unit and the actual plastic pipe drilling without the problems existing in present technique, by simultaneously also significantly decreasing material consumption. The invention first of all enables simplifying the installation of the casing shoe in a way that the coupling of the same with the reamer and at the end of the plastic pipe can be done simultaneously by shrinking the casing shoe in the radial direction, wherein it creates a rotating and in the longitudinal direction locking coupling with the reamer and on the other hand gets pressed against the end of the plastic pipe in the longitudinal direction with a sufficiently long area. Thanks to this, the plastic pipe to be used in drilling does not require any advance preparation, because the casing shoe is coupled directly onto its outer surface.

On the other hand thanks to the invention, there is not necessarily a need for the use of a traditional casing shoe, as the drilling unit can be coupled to the end of a plastic pipe already at a machine shop during a preparation stage by pressing the protrusion assembly in the skirt part at the end of the reamer from a sufficient length onto the end of the plastic pipe while getting "immersed" adequately into its outer surface.

One crucial advantage of the invention is furthermore the fact that it enables making the production related to the plastic pipe drilling more efficient. The coupling according to the invention between the reamer or the casing shoe and the plastic pipe may be carried out significantly simpler than at present by utilizing shrinking technique and, if needed, even with larger diameters than what is typically used in the shrinking technique especially thanks to the simple structure of the skirt part, in which case the wall thicknesses can be minimized when compared to traditional casing shoe constructions. Thanks to the invention, in the coupling between the drilling unit and the casing part a use of high force is thus not required, while on the one hand the invention makes possible material savings and on the other hand more efficient construction, when avoiding installation stages caused by e.g. the longitudinal cutting of the casing shoe.

Other advantageous embodiments of the method and the down-the-hole drilling apparatus according to the invention have been presented in the dependent claims related thereto.

Figures 2A, 2B, 2C:
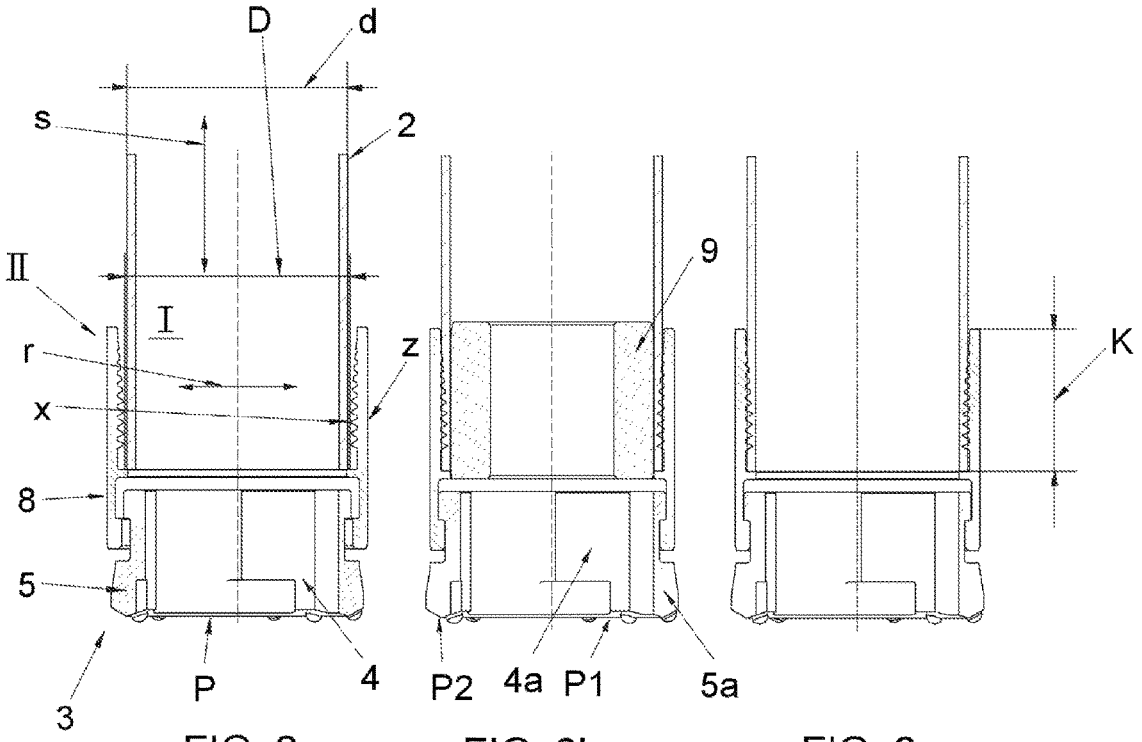
Figure 3A:
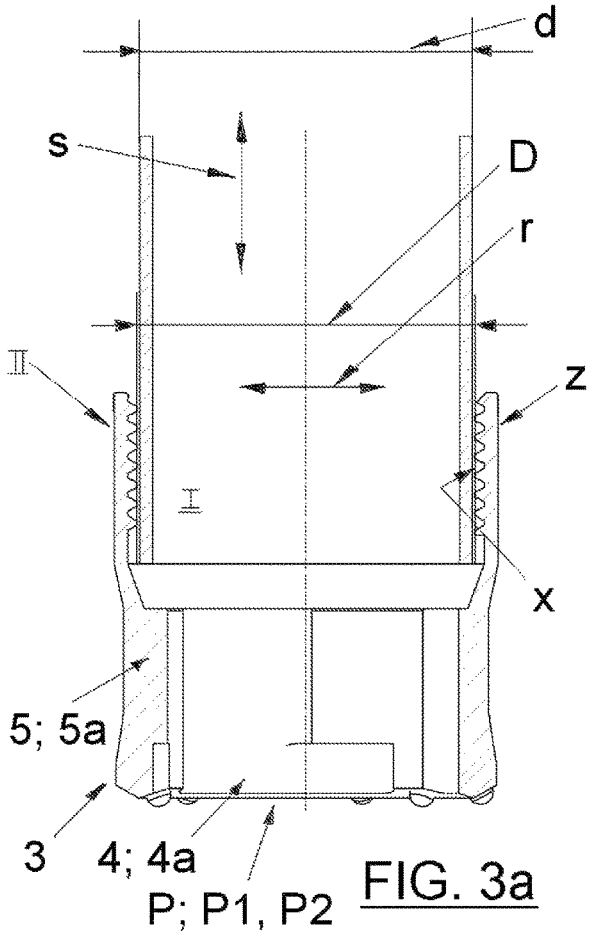
Figure 3B:
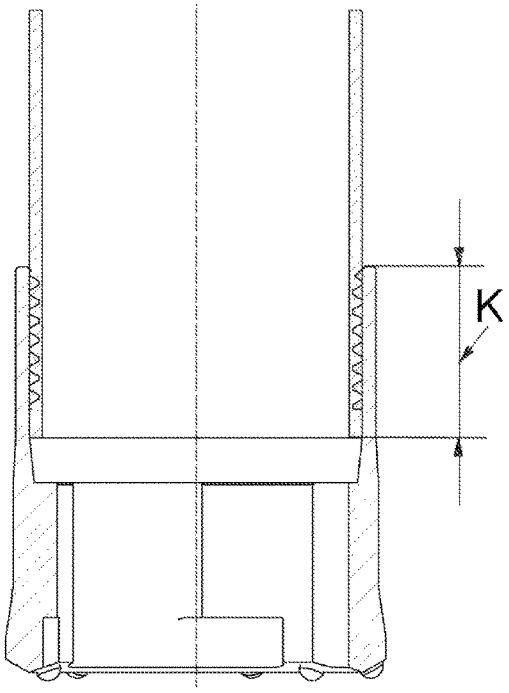
Figures 4A, 4B, 4C:
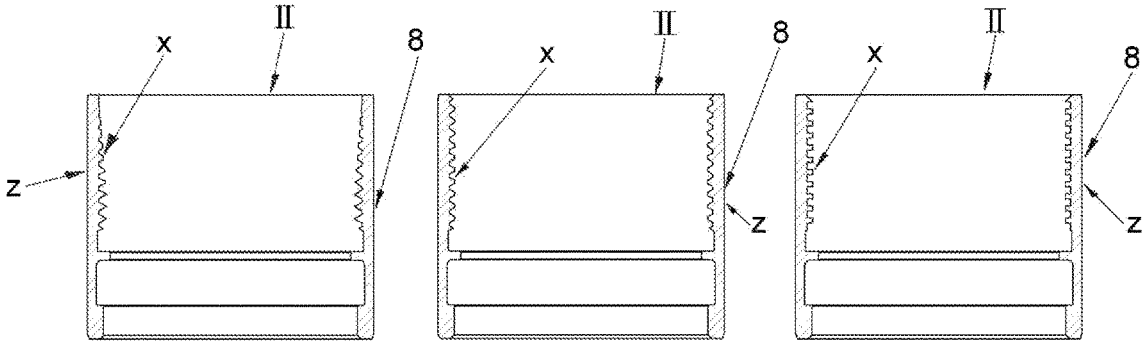

In the following description the invention is being illustrated in detail with reference to the appended drawings, in which in FIG. 1 is shown as a longitudinal cross-sectional view an implication according to prior art related to metal pipe drilling, in which the mutual joint organs of the casing shoe and the reamer are arranged by two successive pulling shoulders in the longitudinal direction in the parts in question, in FIGS. 2*a*-2*c* is shown as longitudinal cross-sectional views working stages of the method according to the invention while exploiting when using a skirt part being arranged in connection with the casing shoe, in FIGS. 3*a* and 3*b* is shown as longitudinal cross-sectional views execution of the method according to the invention with a skirt part being arranged built-in with the reamer, and in FIGS. 4*a*-4*c* is shown as longitudinal cross-sectional views exemplary protrusion assemblies of a skirt part to be utilized in the method according to the invention.

The invention relates first of all to a method for putting together a down-the-hole drilling apparatus for plastic pipe drilling. The down-the-hole drilling apparatus has a drilling device for carrying out drilling by using a drilling unit 3 with a plastic pipe 2, which drilling unit includes in its drilling head a drilling arrangement, such as first drilling means 4 for drilling a center hole and second drilling means 5 for reaming the center hole for the plastic pipe 2, the drilling means 4, 5 being coupled on the first hand at least during a drilling situation mutually in a power transmitting manner in order to carry out co-operation thereof for a rotational motion, a feeding motion and/or a hammering motion, and on the other hand removably in connection with the plastic pipe 2 in order to enable at least removal of the first drilling means 4 from a drilled hole. The plastic pipe 2 is arranged to be pulled into the hole to be drilled by a power influence directed thereto from the drilling unit 3, such as the second drilling means 5 or a casing shoe 8, being coupled with the second drilling means in a manner transmitting power at least in the longitudinal direction of the drilling device. The drilling unit 3 and the plastic pipe 2 are being coupled with each other by a skirt part z that exists at an opposite end II of the drilling arrangement, such as the second drilling means 5 or the casing shoe 8, with respect to the drilling surface P of the drilling unit 3, which skirt part has an internal protrusion assembly x in radial direction r, wherein by pressing the skirt part z together in the radial direction r a contact surface K is being achieved that is formed in the longitudinal direction s along outer surface of the end I of the plastic pipe, in order to pull the plastic pipe 2 into the hole to be drilled by a power influence being transmitted from the contact surface.

As an advantageous embodiment of the method according to the invention, the internal protrusion assembly x, such as an internal threading, formation, tuberculation or the like, that exists at the end of the skirt part z, is being made e.g. according to FIGS. 2*a* and 3*a*, by its internal diameter D essentially larger than the outer diameter d of the end I of the plastic pipe 2, whereby the mutual contact surface K of the protrusion assembly x and the end of the plastic pipe 2, I is being formed by placing the skirt part z provided with the protrusion assembly x in the radial direction r on top of the end I of the plastic pipe and thereafter e.g. according to FIGS. 2*b*, 2*c* and 3*b*, by shrinking at least the skirt part z by compressing the protrusion assembly x in the radial direction r in contact with the outer surface of the end I of the plastic pipe, wherein the protrusion assembly gets at least partly penetrated into the outer surface.

As an advantageous embodiment of the method according to the invention with respect to the embodiments shown in the appended drawings, the drilling head of the drilling device's drilling unit 3 is formed of a first frame part 4*a* and a second frame part 5*a*, wherein drilling surfaces P; P1, P2 formed of end surfaces of the above frame parts are provided with drilling organs of the first and the second drilling means 4, 5, such as an integrated drilling part, separate drilling pieces, bits or like. The protrusion assembly x is being formed advantageously e.g. with reference to the embodiments shown in FIGS. 4*a*-4*c* by working onto an internal surface of the skirt part z a threading, such as one or more in the longitudinal direction s straight or conical machine threads, flat threads, trapezoidal threads and/or the like.

As an advantageous embodiment of the method according to the invention, as the plastic pipe 2 an essentially unpreworked raw pipe preform is being used, which is manufactured particularly for food stuff utilization preferably from PEH-, PVC-plastic or the like, and/or from reinforced plastic, such as fibre-reinforced plastic or the like.

As an advantageous embodiment of the method according to the invention, the skirt part z provided with the protrusion assembly x is being arranged in a built-in manner at inner end II of the second drilling means 5, such as according to FIGS. 3*a*, 3*b* of the reamer or according to FIGS. 2*a*-2*c* of the casing shoe 8. In the embodiment according to FIGS. 2*a*-2*c*, the casing shoe is pressed together from its whole length, whereas in the embodiment according to FIGS. 3*c*, 3*b* only the skirt part z is pressed together.

As an advantageous embodiment of the method according to the invention when shrinking the skirt part z onto the end I of the plastic pipe 2, the plastic pipe is being supported in the radial direction r with a support member being placed inside the plastic pipe.

The invention relates on the other hand to a down-the-hole drilling apparatus, which has a drilling device for carrying out drilling by using a drilling unit 3 with a plastic pipe 2, which drilling unit includes in its drilling head a drilling arrangement, such as first drilling means 4 for drilling a center hole and second drilling means 5 for reaming the center hole for the plastic pipe 2, the drilling means 4, 5 being coupled on the first hand at least during a drilling situation mutually in a power transmitting manner in order to carry out co-operation thereof for a rotational motion, a feeding motion and/or a hammering motion, and on the other hand removably in connection with the plastic pipe 2 in order to enable at least removal of the first drilling means 4 from a drilled hole. The plastic pipe 2 is arranged to be pulled into the hole to be drilled by a power influence directed thereto from the drilling unit 3, such as the second drilling means 5 or a casing shoe 8, being coupled with the second drilling means in a manner transmitting power at least in the longitudinal direction of the drilling device. The drilling unit 3 and the plastic pipe 2 are coupled with each other by a skirt part z that exists at an opposite end II of the drilling arrangement, such as the second drilling means 5 or the casing shoe 8, with respect to the drilling surface P of the drilling unit 3, which skirt part has an internal protrusion assembly x in radial direction r, wherein by pressing the skirt part z together in the radial direction r a contact surface K is achieved that is formed in the longitudinal direction s along outer surface of the end I of the plastic pipe, in order to pull the plastic pipe 2 into the hole to be drilled by a power influence being transmitted from the contact surface.

As an advantageous embodiment of the down-the-hole drilling apparatus according to the invention, the drilling head of the drilling device's drilling unit 3 is formed of a first frame part 4*a* and a second frame part 5*a*, wherein drilling surfaces P; P1, P2 formed of end surfaces of the above frame parts are provided with drilling organs of the first and the second drilling means 4, 5, such as an integrated drilling part, separate drilling pieces, bits or like. The internal protrusion assembly x, such as an internal threading, formation, tuberculation or the like that exists at the end of the skirt part z, is arranged according to FIGS. 2*a* and 3*a* in a prefabrication phase, before coupling the drilling unit 3 and the plastic pipe 2 with each other, essentially larger by its internal diameter D than the outer diameter d of the end I of the plastic pipe 2.

As an advantageous embodiment of the down-the-hole drilling apparatus according to the invention, the skirt part z provided with the protrusion assembly x, such as one or more in the longitudinal direction s straight (FIGS. 4*b*, 4*c*) or conical (FIG. 4*a*) machine threads, flat threads, trapezoidal threads and/or the like on the internal surface of the skirt part z, is arranged in a built-in manner at an inner end II e.g. according to FIGS. 3*a*, 3*b* of the second drilling means 5, such as the reamer, or e.g. according to FIGS. 2*a*-2*c* of the casing shoe 8.

As a further advantageous embodiment of the down-the-hole drilling apparatus according to the invention, the plastic pipe 2 being used in the drilling is an essentially unpreworked raw pipe preform, which is manufactured particularly for food stuff utilization preferably from PEH-, PVC-plastic or the like, and/or from reinforced plastic, such as fibre-reinforced plastic or the like.

Especially when using the embodiment according to FIGS. 3*a*, 3*b*, the plastic pipe gets coupled totally fixed with the reamer, in which case it naturally rotates with the reamer in the drilling, unlike when utilizing according to FIGS. 2*a*-2*c* a casing shoe 8 being coupled rotatively with the reamer 5.

It is clear that the invention is not limited to the embodiments shown or described above, but instead it can be modified within the limits of the basic idea of the invention according to the needs and circumstances, such as the drilling site, at any given time. It is thus clear, that the constructions of the drilling devices being illustrated in the appended drawings may vary in practice very much merely when being carried out with differing diameters. Instead of the type of embodiments shown e.g. in the appended drawings, it is naturally possible to use as the drilling device also other drilling devices that are applicable for the same purpose. It is not that significant for the method and the apparatus according to the invention, either, how the first and second drilling means are coupled to work, so that most heterogeneous solutions can be exploited as the power transmission assemblies between the same particularly thanks to the "external" functioning of the flushing flow with respect to the fastening arrangement starting from a screw joint locking. The invention is naturally applicable for use of a single part drilling device, which in that case does not have a separate reamer and pilot.

The invention claimed is:

1. Method for putting together a down-the-hole drilling apparatus for plastic pipe drilling, which apparatus has a drilling device for carrying out drilling by using a drilling unit with a plastic pipe, the method comprising:

providing a drilling unit, which drilling unit includes a drilling head having a drilling arrangement with a first drilling means for drilling a center hole and a second drilling means for reaming the center hole for the plastic pipe, the drilling means being coupled at least during a drilling situation mutually in a power transmitting manner in order to carry out co-operation thereof for a rotational motion, a feeding motion and/or a hammering motion, and being removably in connection with the plastic pipe in order to enable at least removal of the first drilling means from a drilled hole, whereby the plastic pipe is arranged to be pulled into the hole to be drilled by a power influence directed thereto from the second drilling means or a casing shoe coupled with the second drilling means, in a manner transmitting power at least in the longitudinal direction of the drilling device, coupling the drilling unit and the plastic pipe with each other by a skirt part that exists at an opposite end of the second drilling means or the casing shoe with respect to the drilling surface of the drilling unit, which skirt part has an internal protrusion assembly in radial direction, and pressing the skirt part together in the radial direction to form a contact surface in the longitudinal direction along outer surface of the end of the plastic pipe, in order to pull the plastic pipe into the hole to be drilled by a power influence being transmitted from the contact surface, wherein, in a prefabrication phase prior to pressing the skirt part together, the internal protrusion assembly has a larger internal diameter than an outer diameter of the plastic pipe.

2. Method according to claim 1, wherein the internal protrusion assembly is an internal threading, formation, or tuberculation, that exists at the end of the skirt part, and the method further comprising forming the mutual contact surface of the protrusion assembly and the end of the plastic pipe by placing, in the prefabrication phase, the skirt part provided with the protrusion assembly in the radial direction on top of the end of the plastic pipe and thereafter shrinking at least the skirt part by compressing the protrusion assembly in the radial direction in contact with the outer surface of the end of the plastic pipe such that the protrusion assembly gets at least partly penetrated into the outer surface.

3. Method according to claim 1 in use of a down-the-hole drilling apparatus, in which the drilling head of the drilling device's drilling unit is formed of a first frame part and a second frame part, wherein drilling surfaces formed of end surfaces of the above frame parts are provided with drilling organs of the first and the second drilling means, the frame parts, first and second drilling means being an integrated drilling part, separate drilling pieces, or bits, further comprising forming the protrusion assembly by working onto an internal surface of the skirt part a threading, the threading being one or more in the longitudinal direction straight or conical machine threads, flat threads, or trapezoidal threads.

4. Method according to claim 1, wherein the plastic pipe is an essentially unpreworked raw pipe preform manufactured from PEH-, PVC-plastic, reinforced plastic, or fibre-reinforced plastic.

5. Method according to claim 1, wherein the skirt part provided with the protrusion assembly is being arranged in a built-in manner at an inner end of the second drilling means or of the casing shoe.

6. Method according to claim 1, further comprising shrinking the skirt part onto the end of the plastic pipe, and supporting the plastic pipe in the radial direction with a support member being placed inside the plastic pipe during the shrinking.

7. Down-the-hole drilling apparatus, which has a drilling device for carrying out drilling by using a drilling unit with a plastic pipe, which drilling unit includes a drilling head having a drilling arrangement, with a first drilling means for drilling a center hole and second drilling means for reaming the center hole for the plastic pipe, the drilling means being coupled at least during a drilling situation mutually in a power transmitting manner in order to carry out co-operation thereof for a rotational motion, a feeding motion and/or a hammering motion, and being removably in connection with the plastic pipe in order to enable at least removal of the first drilling means from a drilled hole, whereby the plastic pipe is arranged to be pulled into the hole to be drilled by a power influence directed thereto from the second drilling means or a casing shoe coupled with the second drilling means, in a manner transmitting power at least in the longitudinal direction of the drilling device, characterized in that, the drilling unit and the plastic pipe are coupled with each other by a skirt part that exists at an opposite end of the second drilling means or the casing shoe, with respect to the drilling surface of the drilling unit, which skirt part has an internal protrusion assembly in radial direction, wherein a contact surface is formed by pressing the skirt part together in the radial direction, the contact surface formed in the longitudinal direction along outer surface of the end of the plastic pipe, in order to pull the plastic pipe into the hole to be drilled by a power influence being transmitted from the contact surface, and wherein, prior to pressing, the internal protrusion assembly has a larger internal diameter than an outer diameter of the plastic pipe.

8. Down-the-hole drilling apparatus according to claim 7, wherein the drilling head of the drilling device's drilling unit is formed of a first frame part and a second frame part, wherein drilling surfaces formed of end surfaces of the above frame parts are provided with drilling organs of the first and the second drilling means, the frame parts, first and second drilling means being an integrated drilling part, separate drilling pieces, bits or like, and, wherein the internal protrusion assembly comprises an internal threading, formation, or tuberculation that exists at the end of the skirt part.

9. Down-the-hole drilling apparatus according to claim 7, wherein the skirt part is provided with the protrusion assembly, the protrusion assembly being one or more in the longitudinal direction straight or conical machine threads, flat threads, or trapezoidal threads on the internal surface of the skirt part, the skirt part being arranged in a built-in manner at an inner end of the second drilling means or of the casing shoe.

10. Down-the-hole drilling apparatus according to claim 7, wherein the plastic pipe being used in the drilling is an essentially unpreworked raw pipe preform, which is manufactured particularly for food stuff utilization preferably from PEH-, PVC-plastic, and/or from reinforced plastic, or fibre-reinforced plastic.

11. Down-the hole drilling apparatus according to claim 7, wherein the protrusion assembly is at least partly penetrated into the outer surface of the plastic pipe.

* * * * *